United States Patent [19]

DeVincent

[11] Patent Number: 4,810,224

[45] Date of Patent: Mar. 7, 1989

[54] COMBAT TOY WITH TELEMETRY CONTROLLED DESTRUCT SIMULATION

[76] Inventor: Robert J. DeVincent, 236 N. 2270 West, Provo, Utah 84601

[21] Appl. No.: 23,571

[22] Filed: Mar. 9, 1987

[51] Int. Cl.[4] ..... A63H 30/04; A63B 67/00

[52] U.S. Cl. ..... 446/230; 446/478; 446/477; 446/175; 273/313; 273/310

[58] Field of Search ..... 273/310–313, 273/316, 380; 446/4, 6, 175, 230, 456, 476, 478, 484, 477; 434/22

[56] References Cited

U.S. PATENT DOCUMENTS

| | | | |
|---|---|---|---|
| 3,202,425 | 8/1965 | Van Hennik | 273/312 |
| 3,294,401 | 12/1966 | Nicholas et al. | 273/311 |
| 3,434,226 | 3/1969 | Scholler | 434/22 |
| 3,502,333 | 3/1970 | Fleury | 273/312 |
| 4,212,412 | 7/1980 | Ikeda | 273/310 |
| 4,288,943 | 9/1981 | Ptaszek et al. | 273/316 |

*Primary Examiner*—Richard C. Pinkham
*Assistant Examiner*—Benjamin Layno
*Attorney, Agent, or Firm*—Thorpe, North & Western

[57] ABSTRACT

An action toy for simulating combat between two opposing forces using miniaturized toy combat equipment and target locations. The top comprises at least one miniature combat attack device having a transmitter therein for selecting and generating a radio signal at a preset first frequency. At least one target device is provided and includes a plurality of target components which are releasably coupled together and capable of being dislodged to simulate a combat strike with attendant destruction. The target device includes a receiver pretuned to the first frequency and responsive to its transmission. Detection circuitry is provided to detect the transmission of the first signal and generate a destruct signal. A target release arm is placed proximate to the target component in spring loaded manner and includes a releasable retaining arm which holds the target release arm in a spring loaded, retracted position. Upon detection of the radio signal, the target release arm is activated, causing the dislodgment of the target component simulating a direct hit by the attack device.

16 Claims, 3 Drawing Sheets

COMBAT TOY WITH TELEMETRY CONTROLLED DESTRUCT SIMULATION

BACKGROUND OF THE INVENTION

1. Field of the Invention

This invention pertains to miniaturized combat toys such as jeeps, tanks, combat terrain settings, fighter planes, jets, space ships, space stations and general fortresses More particularly, the present invention relates to such combat devices and settings which are made up of several components which may be collapsed to simulate their destruction.

2. Prior Art

Combat action toys have long been a popular item with children. Miniaturized figures, weapons and combat terrain have long been used to entertain children ho would conduct battle activities between attacking and defending forces.

Such activities have found their setting in simulated conflicts between cowboys and indians, opposing armies of warring nations, cops and robbers, and even non-human characters comprising machines, beasts and virtually every other type of character. Modern imagery has extended the battle field from conventional terrain settings of buildings, bridges and mountainous country to exotic space dimensions having space stations exotic combat vehicles and virtually any option setting of historical or imaginative interest.

Typically, a combination of devices and figures are used to present the full spectrum of activity for any given battle scene. These devices are generally divided into attach and defensive weapons U.S. Pat. Nos. 4,145,049 and 4,342,556 are representative of prior art devices wherein an attack weapon is used against a target.

In addition to play action attack devices, there are those devices which have been adapted to spring apart, simulating an explosion. U.S. Pat. Nos. 2,747,874, 4,509,760 and U.K. Pat. No. 2,068,246 illustrate several target devices which are embodied with means for simulating a direct hit by an attack device. Typically, such devices require physical contact either by an impacting missile or by the operator's hand to cause release of spring loading means within each device, resulting in its component parts flying apart.

Finally, it has long been a practice within the toy industry to develop radio controlled vehicles which enable a user to direct vehicle travel and related activities to be remotely controlled by transmitter. U.S. Pat. No. 3,917,270 is representative of such devices.

Although play action figures and devices for simulating combat by the conventional or space war setting have generated a variety of combat and defensive toys, there is still lacking the responsive realism during a combat encounter in which the target is destroyed, without physical contact of the user's hand or actual contact from a falling object such as a bomb or missile. In most cases, the play action toys involve mere imagination as to physical consequences of a combat encounter. For example, the child merely knocks over figures in an army position or he informs his "enemy" that his attack jet has just destroyed their line of tanks. Although flashing lights and combat sounds are generated by state of the art electronics, there is still lacking a sense of realism which arises where the target explodes apart without need of physical contact and at the activation of the child who is manning the attack vehicle.

OBJECTS AND SUMMARY OF THE INVENTION

It is an object of the present invention to provide play action devices for simulating attack and defense in combat situations wherein the attack party is able to activate destruction of the target by remote control.

It is a further object of the present invention to provide action toys for simulating combat utilizing miniature equipment and target locations which include transmitter and receiver devices to control simulated direct hit and consequential destruction.

A still further object of the present invention is to provide such play action devices which are adapted to simulate the visual, audio and structural interaction arising in play combat.

Yet another object of the present invention is to provide a device and method for coordinating simulated destruction of targets based on remote control from attack devices and which is adaptable to a variety of the simulated combat environments enjoyed by children's play activity.

These and other objects are realized in an action toy for simulated combat between two opposing forces wherein miniaturized toy combat equipment and target locations are utilized. This toy comprises devices which include at least one miniature combat device for simulating an attack or for giving defensive action against an attack. A transmitter device is coupled to the combat device and includes a pre-set first frequency and means for generating a radio signal at that frequency. The transmitter includes a switch for initiating generation of the frequency signal for transmittance. A target device for simulating occurrence of the combat strike comprises a plurality of target components which are releasably coupled together. The target release means are coupled to the target device and operate to effect separation of the component in a simulated explosion. A receiver device which is pre-tuned to the same frequency as the transmitter device is coupled to the target device and target release means. Upon detection of the signal through the receiver, the target release means is activated, causing the separation of coupled target components. The present disclosure provides description of specific embodiments of the features within several types of combat play action toy sets. Also included is a description of the method for use of these devices.

DETAILED DESCRIPTION OF THE INVENTION

Figure 1:
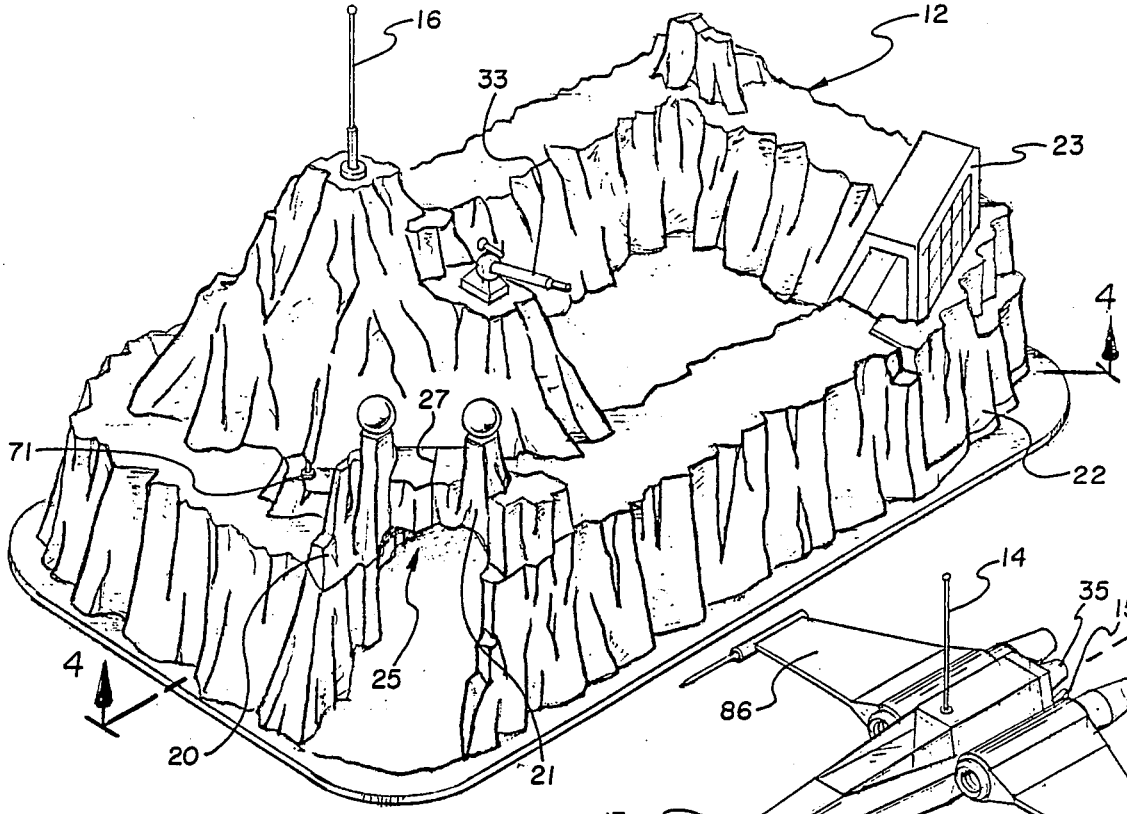
FIG. 1 is a perspective view of a battle station embodied within a mountain-type environment.
Figure 2:
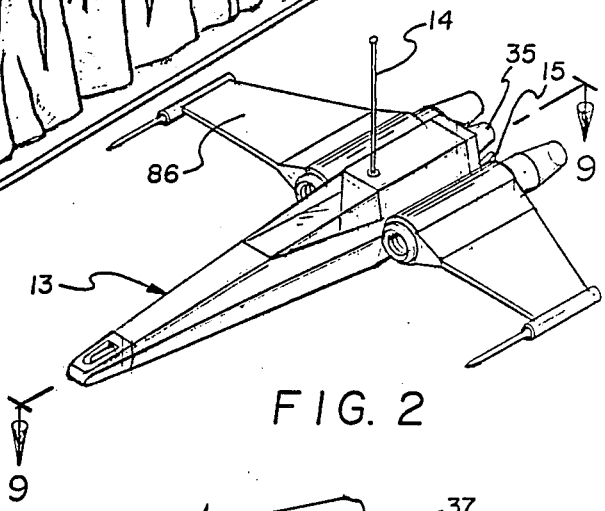
FIG. 2 is a perspective view of a toy-size space ship.

Referring now to the Drawings:

FIG. 1 shows a device comprising a defensive location for simulating combat between opposing forces wherein the defensive location is embodied within mountainous terrain, illustrated generally as 12. Such a device may be used by a child as part of an action game of combat utilizing combat equipment and target locations. An attack vehicle 13 would be manned by one child, while the defensive station 12 was either unmanned or manned by another. These implements would be of a size suitable for manipulation by the hands of the respective children. For example, one child may assume the aggressor role with the attack vehicle 13 or space ship, while the other child assumes a defensive position utilizing armament embodied within the defensive station 12. For purposes of this disclosure, both the defensive station 12 and the attack space ship 13 are considered miniature combat devices for simulating attack or defensive action.

Although two children will typically be involved in the activity, a single child may control the complete combat sequence by activating destruct signals from the attack space ship 13.

Figure 3:
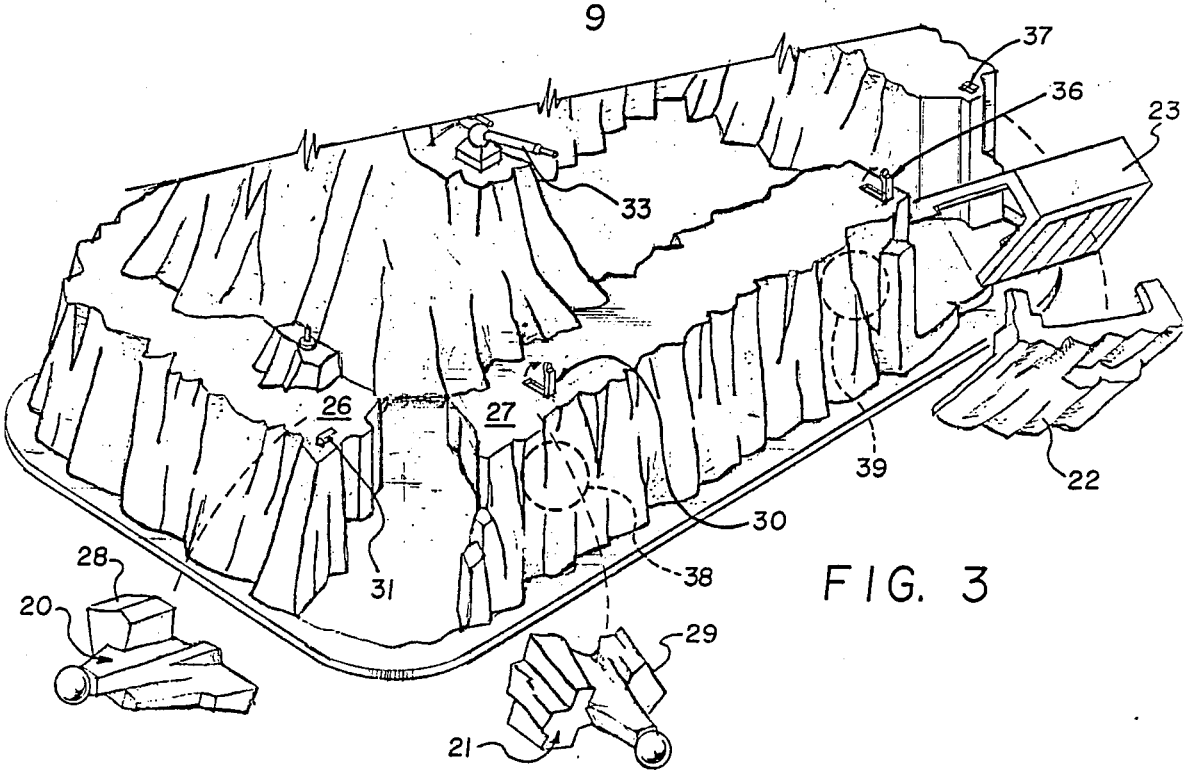
FIG. 3 is a second view of the battle terrain of FIG. 1, showing components in a dislodged condition.
Figure 9:
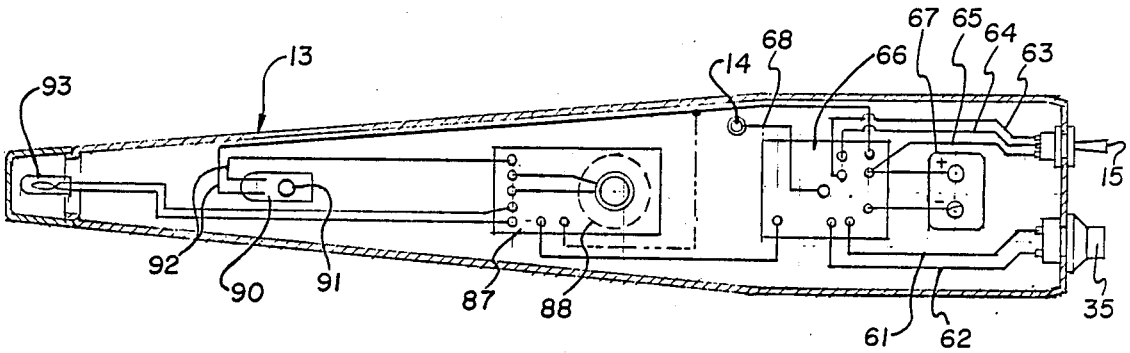
FIG. 9 shows a schematic overlay of electronic control components within the space ship illustrated in FIG. 2.

This space ship 13 has an enclosed transmitter device and antenna 14 which utilizes a preset first frequency. Signal generating circuitry is housed within the space ship 13, as shown in greater detail in FIG. 9. This circuitry is activated by switch 15 located at the rear of the space ship and easily accessible to the hand of the child. This switch would be moved to the ON position at the point in time when the child wishes to activate destruct mechanisms within the defensive position 12 to simulate a successful strike by the space ship. This signal would be transmitted from the ship transmitter antenna 14, to be received at the station transmitter antenna 16. The defensive position 12, operating as the target device for simulating the occurrence of a combat strike, processes the first frequency signal received to activate simulated explosion of one or more target components 20, 21, 22 and 23 which are releasably coupled together. Typically, these target components will represent key locations on the target device which would be primary targets for simulated combat. Components 20 and 21 together form a protective bridge for a particular access port hole 25. The respective bridge members 20 and 21 counter support each other by forming two halves of an arch joining at interface 27. The separated bridge components 20 and 21 are illustrated in FIG. 3 in their dislodged position. Component 20 includes a contact face 28 which abuts against a counter contact face 29 on component 21. The juncture of these opposing faces 28 and 29 form the interface identified as 27 in FIG. 1. These respective components 20 and 21 are supported on support surfaces 26 and 27 respectively.

Each respective surface includes a target release means or lever 30 which operates to separate the coupled components from their supported positions 26 and 27 as illustrated in FIG. 3. Such separation is intended to simulate an explosion which represents a successful combat strike by the combat device 13.

To enhance the realism of the simulated encounter, a micro switch 31 is positioned under one of the target components 20. When in a compressed or engaged position under the weight of the bridge component 20, the micro switch 31 enables laser lights and/or sound from a simulated laser gun to be activated. The operation of this defensive weapon against the attack ship 13 continues until the bridge components 20 and 21 are exploded. At this time, micro switch 31 is released to an OFF position, disabling the lights and sound associated with the laser weapon 33. The termination of sound and light effects of the defensive weapon 33 occurring simultaneously with the destruction of the bridge 20 and 21 develops a realism to the combat encounter.

A similar destructive sequence may be applied to other targets of the target device 12. For example, item 23 may represent a command headquarters, a computer room or other key location of the defense facility. By using a selector switch 35, a second frequency can be activated upon engaging the ON/OFF switch 15. This second frequency would again be received by the telemetry receiver and antenna 16 which would process a signal for activating the target release means 36 associated with components 22 and 23. Activation of target release means 36 dislodges component 23 by spring action. Component 22 falls free from its position because of loss of the support weight required by item 23. Micro switch 37 automatically releases from its biased, closed position with loss of the support weight from component 23. This micro switch opens associated circuitry which might include flashing lights within the command center or other weapons which terminate upon the successful strike against this section of the defensive station 12.

In each case, the attack vehicle may be utilized to select one of several preset frequencies and thereby select the target to be exploded by the telemetry signal. The receiver 16 processes the signal and allocates the assigned destruct command to the appropriate location.

Figure 5:
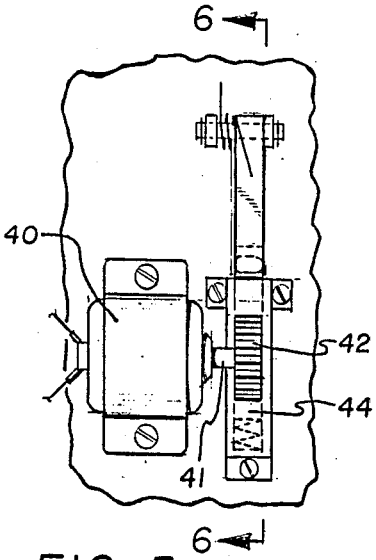
FIG. 5 is an enlarged view of the operating motor enclosed within 5—5 of FIG. 4.
Figure 6:
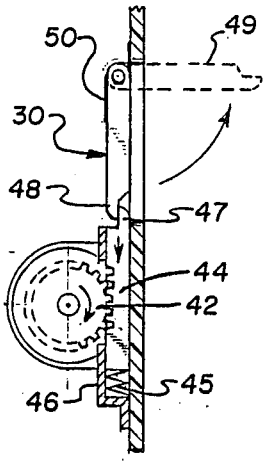
FIG. 6 is a cross section view taken along the lines 6—6 of FIG. 5.

Several means may be utilized to activate the target release devices 30 and 36. FIGS. 5 through 8 show two embodiments of activating means for the target release levers 30 and 36. FIGS. 5 and 6 illustrate the use of an electric motor 40 having a shaft 41 and coupled gear or pinion 42. The relative position of this motor is shown at each hidden location 38 and 39 under the respective target release arms 30 and 36. Motor 40 corresponds to location 38 and motor 43 corresponds to location 39.

As is shown more clearly in FIG. 6, the gear or pinion 42 engages a rack 44. Upon activation of the motor 40, the rack 44 is thrust downward against a spring 45 within a rack casement 46. An attached foot 47 is pulled free from a foot member 48 of the release arm 30. This arm is spring biased to an open position 49. Upon release of the retaining foot 47, the release arm 30 is free to flip to its projected position 49. The spring mechanism 50 which provides the spring biased tension to the release arm 30 has sufficient strength to dislodge the bridge component 21 from its position at base 27.

Figure 7:
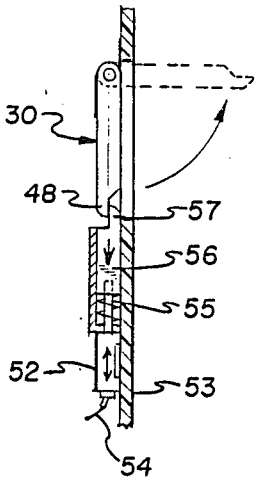
FIG. 7 is an alternate embodiment of the cross section shown in FIG. 6, utilizing an electric solenoid.

FIG. 7 discloses an alternate embodiment utilizing a solenoid mechanism. A solenoid element 52 is coupled to a wall of the device 53 and is electrically coupled 54 to the control circuitry set forth in FIG. 4. The solenoid member operates a plunger 55 which is coupled to a slidable element 56 having a retainer foot 57 for engaging the foot 48 of the release arm 30. The solenoid embodiment of FIG. 7 operates in a manner similar to that disclosed for the motorized mechanism of FIG. 6.

Figure 4:
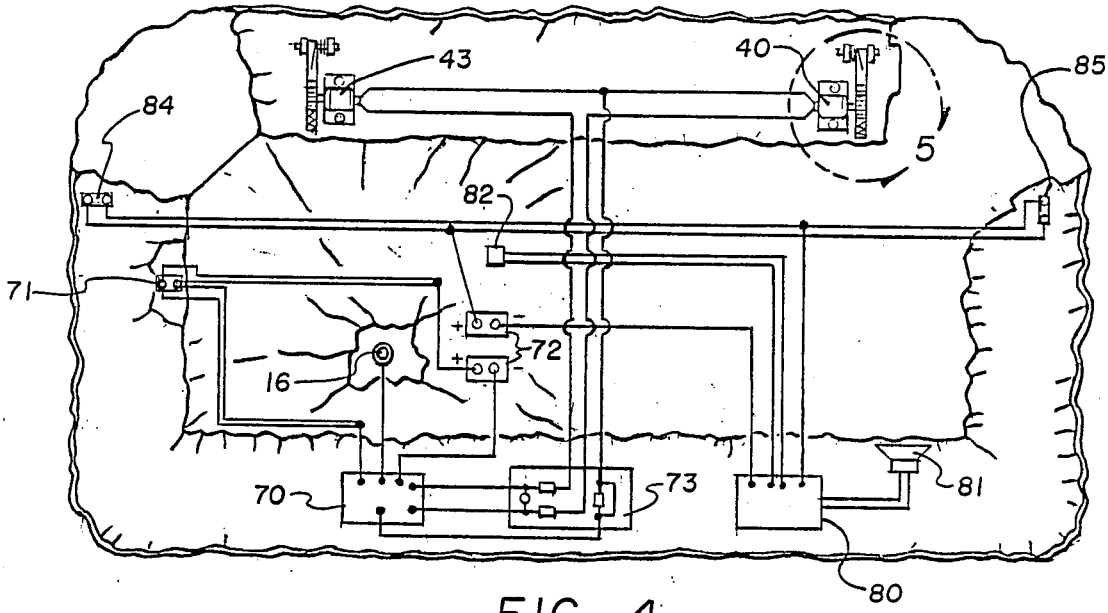
FIG. 4 is a schematic layout of operating circuitry in overlay position with respect to the combat terrain shown in FIG. 1.

The control circuitry for activating the motor or solenoid, or other form of power for the release mechanism, is set forth in FIG. 4. In this embodiment, the respective motors 40 and 43 are independently operated, based on the frequency selected by switch 35 in the attack ship 13. As indicated previously, selector 35 identifies which frequency shall be sent, and thereby which target components will be affected, the block diagram circuitry shown in FIG. 9. Generally speaking, selector 35 provides at least three positions of choice. A first knob selection closes a circuit with line 61 which might activate the release arm coupled to components 22 and 23. A second position would close the circuit with line 62, and might affect dislodgment of component parts 20 and 21. A third position could activate both lines 61 and 62 to cause the concurrent dislodgment of all components of the defense station 12. Similarly, switch 15 may be used to select specific combinations, in addition to the selection capability of knob 35. Switch selection 63 may detonate components 22 and 23; switch 65 may detonate components 20 and 21; and switch location 64 would be the inactive setting where no signal was generated. The switch could obviously be combined with knob settings 35 to develop other control capabilities.

These respective switches 15 and 35 are coupled into the transmitter 66 which is powered by battery 67 contained within the body of the space ship 13. Typically, this transmitter is a frequency modulated device which generates an FM signal in line-of-sight relationship to a receiving antenna 16. This FM signal is transmitted via line 68 to the antenna 14. It will be apparent to those skilled in the art that other forms of telemetry signals may be used to accomplish the objects of this invention. For example, an infrared radiation (IR) source could be substituted for the FM transmitter, with an IR sensitive detector used as the receiver. Similarly, other forms of receiver-transmitter combinations may be substituted, depending on the nature of telementry signal to be used.

Figure 8:
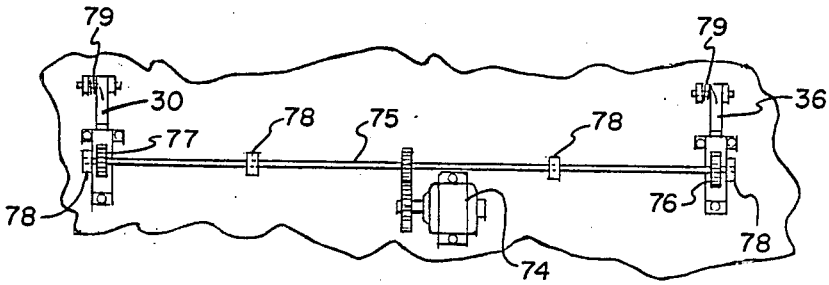
FIG. 8 illustrates a different embodiment of the release mechanism for trip switch elements.

The receiving antenna 16 (FIG. 4) is coupled to an FM receiver 70. This receiver is powered by an ON/-OFF switch 71 and coupled set of batteries 72. Control circuitry 73 provides selective response to motors 40 and 43, based on the received signal from the attack ship 13. This circuitry would activate either or both motors, depending upon the selected setting transmitted from the attack ship. It should be apparent to those skilled in the art that a single activation configuration could similarly be applied as represented in FIG. 8. This embodiment utilizes a single motor 74, a single rotary shaft 75 and a pair of gears 76 and 77 to implement the same operations as illustrated in FIG. 6. The shaft 75 is supported by a set of support bridges 78 which stabilize the shaft during operation. Release arms 30 and 36 would operate in a manner similar to that previously shown. Each arm is spring biased by a load spring 79. Although the same embodiment provides for concurrent operation of both release arms and is more economical utilizing a single motor, the preferred embodiment permits the use of additional frequencies from the transmitter of the attack device, with the receiver device being tuned to the specific frequencies to enable selective attack of several defensive components.

These various features can be combined within a method for simulating combat between two opposing forces. The method is practiced by selecting and preparing a miniature combat device such as the attack ship 13 for engagement. A transmitter device is installed within the attack ship and preset to a first frequency for generating a specific radio signal. Switch means are provided for activating the transmitter device to generate this frequency signal at the choice of the user. A target device is prepared, such as the defense station 12, for simulating occurrence of a combat strike. Target components 20 and 21, 22 and 23 are releasably coupled together to give the appearance of a stable, fully prepared structure. Target release means are installed within the target device in a spring loaded or counter supporting condition such that activation of the release means causes the coupled components 20 and 21, 22 and 23 to fly apart, simulating an explosion representing a successful combat strike. A receiver device is installed within the target device and is made responsive to the signal generated at the first frequency by the attack ship 13. Electric motors or other mechanical means are provided at the release arms 30 and 36, being coupled to the mechanical motors 40 and 43 to activate the release arms upon the appropriate radio signal.

To add to the realism of the simulated combat experience using the present invention, light and sound effects are included and made responsive to the telemetry commands used to activate the release arm and destruct mechanism. Specifically, a miniaturized defensive weapon such as the laser gun 33 includes means for generating sound effects simulating the firing of the weapon. These may be developed by a prefabricated semi-conductor chip having a variety of sounds which can be selected by the user. This chip is included within the noise amplification circuit 80 which powers a speaker 81 used to broadcast the desired sound effect. Similarly, a light emitting diode 82 or other source of light radiation may be coupled into the amplification circuitry 80 for generating light emission in concert with the sound emission.

The actual sound and light effects are generated prior to the destruct sequence which is initiated with the telemetry signal from the attack vehicle 13. When the electronics circuitry for the defense station 12 is activated by switch 71 the light and sound effects may be operational. Actual generation of sound and light emissions would be controllable by the child manning the laser gun 33 via an ON/OFF mechanism such as a firing button or toggle switch. Basically, the child is free to simulate the light and sound of combat until the dislodgment of one of the defense components 20 or 23 occurs. At that time, spring biased micro switches 31 and 37 are released, opening the circuit enabling sound and/or light emissions at points 84 and 85 respectively. The effect of the release of these micro switches is to abruptly interrupt the firing of the laser weapon 33 at the same instant that the attack ship 13 has a successful strike against either of the defensive positions. It will be apparent to those skilled in the art that other mechanisms may be utilized to coordinate disruption of the sound and light emissions simultaneously with the destruction of any part of the defensive station 12.

It will also be apparent that the attack ship 13 or other type of attack device could also be embodied with destructible components which fly apart upon an appropriate signal from the defense station 12. The same telemetry procedures and components could be utilized to generate a signal which would be received by the antenna 14, which could be coupled to a receiver pretuned to an appropriate frequency. For example, a portion of the wing 86 might be released by such a signal generated from the defense station. In addition, the signal could activate a preprogrammed sound effect from an amplifier circuit 87 within the attack ship which simulates a distressed, squealing sound leading to the sound effects of an explosion. Such sound effects could be included within the amplifier 87 and its associated speaker 88. Similarly, light effects could preprogrammed within the ship 13 to further dramatize the explosive destruction of the air craft.

These sound effects and light effects in addition to other sound and light effects, can be generated during the attack of the air craft 13. For example, a gravity ball switch 90 may be used to automatically generate firing sound effects of a laser cannon as the air craft assumes a dive orientation, with the ball element 91 falling into contact with leads 92. Similarly, light emissions 93 can be generated to simulate a laser cannon from the nose of the air craft 13. Upon a defensive strike which disables the air craft, these systems would be disabled or replaced by the destructions light and sound effects preprogrammed within semiconductor chips of the amplifier 87.

The complexity of the simulated combat experience can be increased by including within the receiver circuitry 70 and 73. For example, the child manning the defensive station 12 might preset a required sequence of order for the preset radio signals. Specifically, the required destruct sequence may be the signal for activating dislodgment of elements 22 and 23. The receiving circuitry would only acknowledge reception of the other signal for dislodging components 20 and 21 after the previous signal had been transmitted. This could be repeated with any number of components that might make up the defensive station. The more components existing, the greater the difficulty in deciphering the correct sequence of destruction.

Similarly, the child manning the attack vehicle could preprogram a series of signals which must be sequentially received at the antenna 14 before the sound and light effects representing total destruction of the space ship would be triggered. This sequencing procedure developes a competitive challenge to the simulated combat activity. During the actual combat, each child would be attempting various sequence patterns to discover the correct, preprogrammed sequence. This would allow time various maneuvering operations and would prevent each child from merely activating all destruct mechanisms at the initial encounter.

Figure 10:
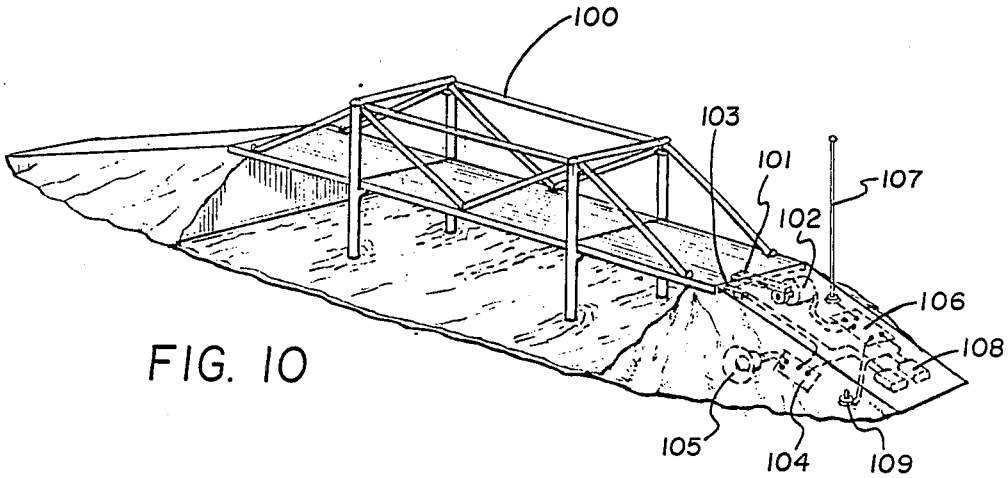
FIG. 10 illustrates a second combat environment comprising a collapsible bridge.
Figure 11:
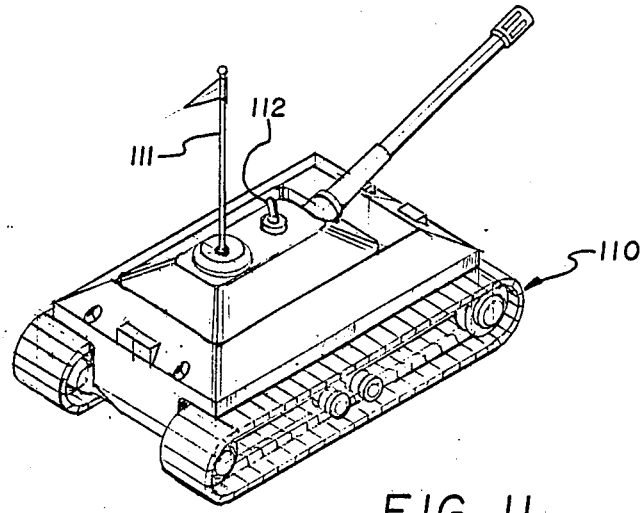
FIG. 11 shows an alternate attack vehicle comprising a tank constructed in accordance with the present invention.

FIGS. 10 and 11 illustrate a different combat environment which may be utilized to implement the same elements of invention. FIG. 10 shows a collapsible bridge 100 which is the target device, similar to defensive station 12. It includes a release arm 101 operated by an electric motor 102 in a manner similar to that shown in FIGS. 5 and 6. Similarly, a micro switch 103 is provided to interrupt sound effects generated by the sound amplifier 104 and its coupled speaker 105. Activation of the motor 102 is controlled by receiver 106 and coupled antenna 107. The system is powered by a pair of batteries 108 and controlled by an ON/OFF switch 109. Further explanation of component operation is deemed unnecessary in view of the similar operation capabilities of the same elements described for the defensive station 12.

Similarly, FIG. 11 discloses an attack device 110 representing a ground maneuverable tank. A transmitting antenna 111 provides the telemetry signal from transmitter components contained within the tank structure. Such circuitry is comparable to that shown in FIG. 9, except for elements 61, 62, 90, 91 and 92. A transmit switch 112 is provided at the top of the tank for activating the telemetry signal. This signal would be received at antenna 107, being detected in the receiver 106. The receiver activates the motor 102 and coupled release arm 101. This release arm is retracted in a spring loaded position such that its release causes it to fly free, rotating upward and flipping the bridge components from their coupled positions.

It will be apparent to those skilled in the art that other embodiments and variations of attack and defense devices may be envisioned. It is to be understood, therefore, that the disclosure set forth previously is not to be deemed limiting, except as provided in the following claims.

I claim:

1. An action toy for simulating combat between two opposing forces using miniaturized toy combat equipment and target locations, said toy comprising:

at least on miniature combat device for simulating attack or defensive action;

a frequency modulated (FM) transmitter device including a preset first frequency and being directly coupled to the combat device, said transmitter being capable of generating a telemetry signal at the first frequency;

manual switch means for activating the transmitter device to generate the first signal;

at least one target device for simulating occurrence of a combat strike, said target device comprising a plurality of target components which are releasably coupled together;

target release means coupled to the target device and operable to effect separation of the coupled components to simulate an explosion representing a successful combat strike from the combat device;

a frequency modulated (FM) receiver device directly responsive to the first frequency and being coupled to the target device and target release means, said receiver device being capable of detecting the signal at the first frequency; and means for activating the target release means directly upon detection of the first signal by the receiver device to cause the target components to collapse or fly apart.

2. A toy as defined in claim 1, wherein the combat device comprises a hand-held toy which is maneuvered in the air to simulate a flight attack against the target device.

3. A toy as defined in claim 2, wherein the hand-held toy comprises a space flight vehicle.

4. A toy as defined in claim 1, wherein the combat device comprises a toy which is maneuvered along the ground to simulate a ground attack against the target device.

5. A toy as defined in claim 4, wherein the combat device comprises a terrain vehicle having a miniature cannon mounted thereon.

6. A toy as defined in claim 1, wherein the target device comprises a ground-mounted structure whose several components are mutually supported by each other in standing contact, said target release means comprising a movable arm which dislocates at least one of the target components and causes the target device to collapse.

7. A toy as defined in claim 6, wherein the ground mounted structure also includes an attack device with transmitter means for providing defensive action against the first attack device or other targets.

8. A toy as defined in claim 6, wherein the target device includes means for holding the respective components of the structure together in an assembled manner, and wherein the release means comprises a moveable arm which releases the holding means to disconnect the target components.

9. A toy as defined in claim 8, wherein the release means includes a spring biased member which is in tension while in a retracted position against at least one of the components and which develops a spring action upon release to cause the components to fly apart, simulating an explosion.

10. A toy as defined in claim 1, wherein the attack device and transmitter include additional frequencies which may be selected by an operator for simulated attack on other target devices wherein such other target devices having receiver devices respectively tuned to the additional frequencies to respond upon detection of a common frequency signal to collapse in simulation of a successful attack.

11. A toy as defined in claim 10, further comprising means for programming a sequence of selected attack targets which must be engaged in the selected sequencial order.

12. A toy as defined in claim 11, wherein the target device includes a plurality of defensive attack devices which include means for programming a sequence of selected attack targets which must be engaged in the selected sequencial order.

13. A toy as defined in claim 1, further comprising sound generating means coupled to the target device and being responsive to activation of the release means to disable generation of sounds of combat.

14. A toy as defined in claim 1, further comprising sound generating means coupled to the attack device and being responsive to activation of the release means to disable generation of sounds of combat.

15. A toy as defined in claim 1, wherein the target release means comprises a rack and pinion assembly wherein the rack includes means for retaining a release arm in a spring loaded, retracted position and in contact with a target component such that movement of the rack results in release of the release arm and dislodgment of the target component, said pinion being coupled to the shaft of an electric motor positioned so as to rotate and cause retraction of the rack from its retaining position with respect to the release arm.

16. A toy as defined in claim 1, wherein the target release means comprises a rack and pinion assembly wherein the rack includes means for retaining a release arm in a spring loaded, retracted position and in contact with a target component such that movement of the rack results in release of the release arm and dislodgment of the target component, said pinion being coupled to the shaft of an electric solenoid positioned so as to rotate and cause retraction of the rack from its retaining position with respect to the release arm.

* * * * *